US005256037A

United States Patent [19]

Chatelain

[11] Patent Number: 5,256,037

[45] Date of Patent: Oct. 26, 1993

[54] SELF BALANCING MOTOR

[76] Inventor: Michael R. Chatelain, P.O. Box 115, Hessmer, La. 71341

[21] Appl. No.: 903,145

[22] Filed: Jun. 24, 1992

[51] Int. Cl.[5] ..... F04D 29/32

[52] U.S. Cl. ..... 417/423.7; 417/424.1; 416/5; 310/51

[58] Field of Search ..... 417/423.7, 424.1; 416/5; 310/51

[56] References Cited

U.S. PATENT DOCUMENTS

| | | | |
|---|---|---|---|
| 331,450 | 12/1885 | Rothe . | |
| 2,525,781 | 10/1950 | De Remmer . | |
| 2,836,083 | 5/1958 | Smith . | |
| 3,282,127 | 11/1966 | Deakin . | |
| 3,321,997 | 5/1967 | Peterson . | |
| 3,339,429 | 9/1967 | Whilock . | |
| 3,733,923 | 5/1973 | Goodrich et al. | 74/573 |
| 4,388,841 | 6/1983 | Gamble . | |
| 4,640,668 | 2/1987 | Yang | 417/423.7 |
| 4,674,356 | 6/1987 | Kilgore . | |
| 4,720,241 | 1/1988 | Markwardt . | |
| 4,900,236 | 2/1990 | Kapann . | |

*Primary Examiner*—Richard A. Bertsch
*Assistant Examiner*—David W. Scheuermann
*Attorney, Agent, or Firm*—David L. Ray

[57] ABSTRACT

In accordance with the present invention there is provided an apparatus and method for balancing an electric ceiling fan. The apparatus includes a circular hollow ring connected to the rotating housing of a ceiling fan motor, or to the ceiling fan blades, which ring contains a plurality of metal spheres, or liquid, movable within the ring to balance the ceiling fan. The method of the invention includes connecting a circular hollow ring to the rotating portion of a ceiling fan, and placing liquid or metal spheres inside the circular hollow ring to balance the ceiling fan.

15 Claims, 4 Drawing Sheets

SELF BALANCING MOTOR

BACKGROUND OF THE INVENTION

1. Field of the Invention

The invention relates to electric motors used in ceiling fans. More particularly, the present invention relates to methods and apparatus for balancing ceiling fan electric rotary motors.

2. Description of the Related Art

Rotary ceiling fans are well known in the art. A problem frequently occuring in an installed ceiling fan is balance. The blades of the fan, or the internal elements of the fan, may not be properly aligned or the weight may not be evenly distributed, thereby causing the fan to gyrate about its axis. Such gyration or wobbling causes uneven airflow, occasionally unpleasant noise, and may cause excessive wear of the fans and its components.

Exemplary of ceiling fans of the prior art are those disclosed in the following U.S. Patents:

U.S. Pat. No. 4,900,236 discloses a ceiling fan including a rotatable assembly to which the fan blades are attached and a stationary assembly capable of being connected to a suspension device. These assemblies have a common centerline, and the rotary assembly includes the rotor and the stationary assembly, the stator, located concentrically inside the rotor, of an electric motor. The rotatable assembly is mounted rotatable relative to the stationary assembly by means of a tubular member extending coaxially with the centerline and a shaft located therewithin. Two bearings are located at a distance one above the other and are mounted between the shaft and the tubular member, at least one of which bearings is a roller bearing. The other one of the two bearings is a journal bearing.

U.S. Pat. No. 4,720,241 discloses a spinner-type electrical ceiling fan having a three part housing which includes a top plate, a central annular band and a bottom plate. The top and bottom plates have depressed, bearing-receiving hubs disposed therein at a central location. An iron armature is secured to the top and bottom plates, with the central annular band snapped into position between the top and bottom plates and around the periphery of the iron armature.

Exemplary of balancing devices of the prior art for rotary devices are those disclosed in the following U.S. Patents:

U.S. Pat. No. 4,674,356 discloses a dynamic rotational counterbalance structure including a discoid balance body having a groove or race formed in an outer circumferential surface of the body. A plurality of movable weights such as spherical weights are positioned in the groove along with a lubricating and noise damping fluid. The groove is closed by an outer circumferential band. At least two of the balance structures are affixed coaxially on a rotatable member to be balanced. During rotation of the member so balanced, the weights shift circumferentially to offset unbalancing forces which influence the rotating member.

U.S. Pat. No. 4,388,841 discloses a load balancing device for rotation apparatus such as washing machines and vehicle tires. In one embodiment the present invention includes an inner conduit defining an interior raceway which contains a high density fluid mass which shifts to oppose load imbalances. Universal mounting brackets are provided attached to the balancing ring to the rotating structure. The attachment brackets are slidable along the ring and adjustable and adapted for securement in various arrangements. In other embodiments the attachment brackets are adapted to accommodate various wheel configurations and bolt spacings for vehicles.

U.S. Pat. No. 3,733,923 discloses an economical automatic balancer for rotating masses characterized by a circular rigid self-sustaining race formed of a precision bent metallic tube having its ends welded together and having a substantially uniform internal diameter so as to define a smooth raceway for spherical counterweights; a plurality of counterweights and a lubricating and damping fluid movably disposed within the race; and a device for rigidly connecting the race with the rotating mass such that the spherical counterweights and a lubricating and damping fluid movably disposed within the race; and a device for rigidly connecting the race with the rotating mass such that the spherical counterweights will align themselves within the race so as to compensate for dynamic unbalance thereof. The use of the precision bent metallic tube effects an automatic balancer that is advantageous over similar prior art balancer, is easily installed in a wide variety of applications, yet is much more economical in its total cost that the prior art balancers.

U.S. Pat. No. 3,339,429 discloses a dynamic balancing system for rotating shafts which includes a clamp for connection around the shaft including a pair of clamp halves generally V-shaped and each having a pair of serrated faces for engaging a cylindrical shaft at two circumferentially-spaced points, the faces having a concave radius of curvature at least greater than the radius of curvature of the shaft and being correspondingly formed with respect to a line bisecting the angle between he faces whereby each clamp half with be automatically centered on cylindrical shafts of different diameters, a plurality or arms connected to the clamp and extending from the shaft at circumferentially-spaced points, and a dynamic balancing ring connected to the arms for disposition concentrically about the shaft.

U.S. Pat. No. 3,321,997 discloses a load equalizer in a vertical spin tub automatic washing machine including a carrier member encircling and secured to rotate with the spin tub, mass members retained by the carrier member peripherally translatable thereto and compressible, and countervailing separator members disposed between mass members for urging the mass members apart.

U.S. Pat. No. 3,282,127 discloses a balancer unit for shafts and other rotarily driven elements having a heavy side and a light side, the balancer unit including weighty balls and a device defining a circumferential ball-receiving and confining path about the axis of the shaft or other driven elements; the balls occupying substantially less than the circumference of the path; the improvement including an annular inner wall-providing but outwardly open ball carrier concentrically and fixedly mounted on the shaft, the inner wall of the carrier providing an outwardly extending circumferential flange defining the outer margin of the ball path, a removable closure secured to the open outer portion of the carrier, a shaft-surrounding weighty annular member in the carrier and having an internal diameter greater than the shaft diameter, a circumferentially arranged yielding device interposed between the shaft and the inner periphery of the annular weighty member to floatingly support the latter in concentric relationship with the shaft when the latter is in motion with the balls in operative shaft balancing position at the "light side" of the latter or when the shaft is stationary, a circumferential series of radially shiftable ball-engageable elements in the carrier and actuated outwardly by a yielding device to normally engage balls in the ball path, a cooperating device provided by annular weighty member and the ball engageable elements for moving inwardly those of the latter remotely located with reference to the direction of movement of the weighty member under centrifugal shift-rotation-induced action so long as the shaft is out of balance.

U.S. Pat. No. 2,836,083 discloses a balancing ring system for a rotatable container mounted on a vertical axis and adapted to hold articles to be rotated with the container, a closed annular duct carried by the container concentric to the geometric axis of the container, a thixotropic substance partially filling the duct and remaining immobile below the critical speed of the container, and a device for rotating the container above the critical speed to flow the substance within the duct and minimize possible unbalanced conditions resulting from the presence of the articles within the container.

U.S. Pat. No. 2,525,781 discloses balancing of rotatable bodies including placing one or more hollow rings partially filled with liquid around the basket. The ring may contain any desirable liquid but it is preferred to use a liquid having a higher density than water, such as a saturated solution of potassium carbonate. Preferably the height(axial dimension) of the ring is at least several times its thickness(radial dimension) for most efficient balancing action.

U.S. Pat. No. 331,450 discloses a centrifugal rotating machine having hollow rings therearound filled with liquid or with balls, or a combination of liquid and balls, or flexible rings therearound formed by endless chains or ropes, to establish equilibrium of the rotating centrifugal machine.

SUMMARY OF THE INVENTION

In accordance with the present invention there is provided an apparatus and method for balancing an electric ceiling fan. The apparatus includes a circular hollow ring connected to the rotating housing of a ceiling fan motor, or to the ceiling fan blades, which ring contains a plurality of metal spheres, or liquid, movable within the ring to balance the ceiling fan. The method of the invention includes connecting a circular hollow ring to the rotating portion of a ceiling fan, and placing liquid or metal spheres inside the circular hollow ring to balance the ceiling fan.

BRIEF DESCRIPTION OF THE PREFERRED EMBODIMENTS

Figure 1:
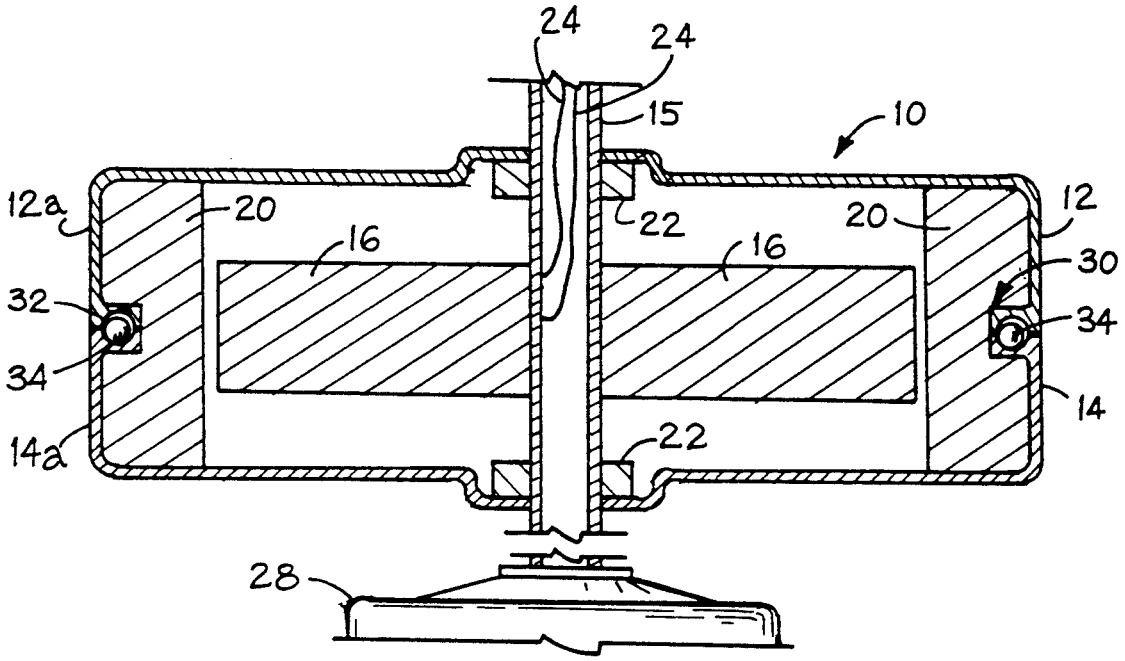
FIG. 1 is a partly cut-away cross-sectional view of a rotary ceiling fan electric motor housing having a first embodiment of the balancing apparatus of the present invention incorporated therein.

Referring now to the drawings, in FIG. 1 is shown the ceiling fan electric motor housing of the first embodiment of the invention generally indicated by the numeral 10. Housing 10 has a top plate generally indicated by the numeral 12 and a bottom plate generally indicated by the numeral 14. Top plate 12 has a generally cylindrical outside wall **12*a*, and bottom plate 14 has a generally cylindrical outside wall 14*a* aligned with outside wall 12*a*. Top plate 12 may be connected to bottom plate 14** by any conventional means such as welding, screwing, bolting or the like.

Housing 10 is adapted to rotate about central shaft 15. Central shaft 15 is connected at its upper end to cover 18 shown in FIG. 2. Central shaft 15 has a stator 16 of the electric motor contained in housing 10 connected thereto. Rigidly connected to housing 10 is rotor 20 which is positioned concentrically about stator 16. Rotor 20 and housing 10 rotate on bearings 22 connected to shaft 15 when stator 16 is electrically energized through electrical lines 24 as is known in the art. Typical of such electric ceiling fans is the fan shown in U.S. Pat. No. 4,720,241 which is hereby incorporated by reference.

Figure 2:
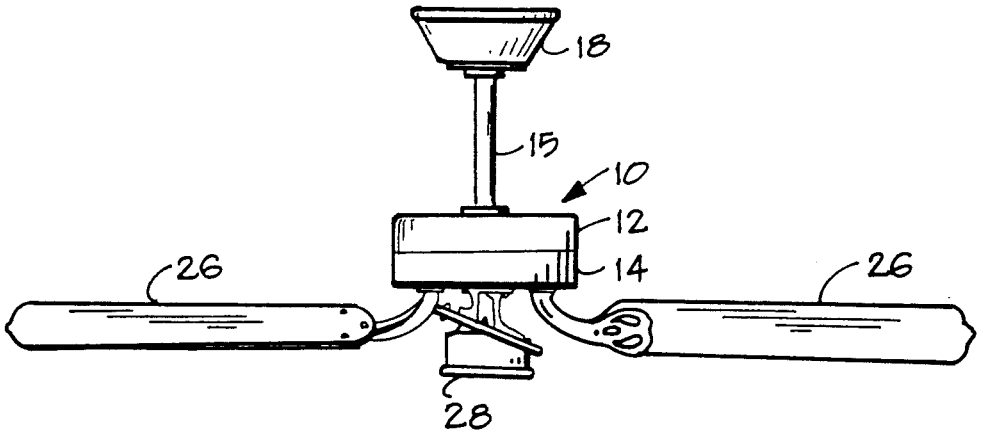
FIG. 2 is a plan view of a rotary ceiling fan utilizing the electric motor housing shown in FIG. 1.

Referring now to FIG. 2, the housing 10 can be seen to have fan blades 26—26 rigidly connected to bottom plate 14. Fan blades 26—26 therefore rotate with housing 10. A light receptacle or other ornamental device 28 may be connected to the bottom of shaft 15 as shown in FIGS. 1 and 2. If desired, device 28 may be omitted.

To balance housing 10, and the entire ceiling fan assembly, there is provided a hollow circular ring generally indicated by the numeral 30 provided on the interior of housing 10 as shown in FIG. 1. Ring 30 extends completely around the interior of housing 10 and has a hollow center 32 which also extends completely around the interior of housing 10.

Inside of hollow center 32 are a plurality of metal spheres 34 to provide a balancing force. The number of metal spheres 34 may vary depending on the degree of imbalance of the ceiling fan and the combined weight of the spheres. The top plate 12 can be separated from the bottom plate 14 to add more metal spheres 34 or remove some of the metal spheres as desired to balance the ceiling fan. If desired, an access port to hollow center 32 could be provided for adding or remove metal spheres to ring 30 without the necessity of separating top plate 12 from bottom plate 14.

Figure 3:
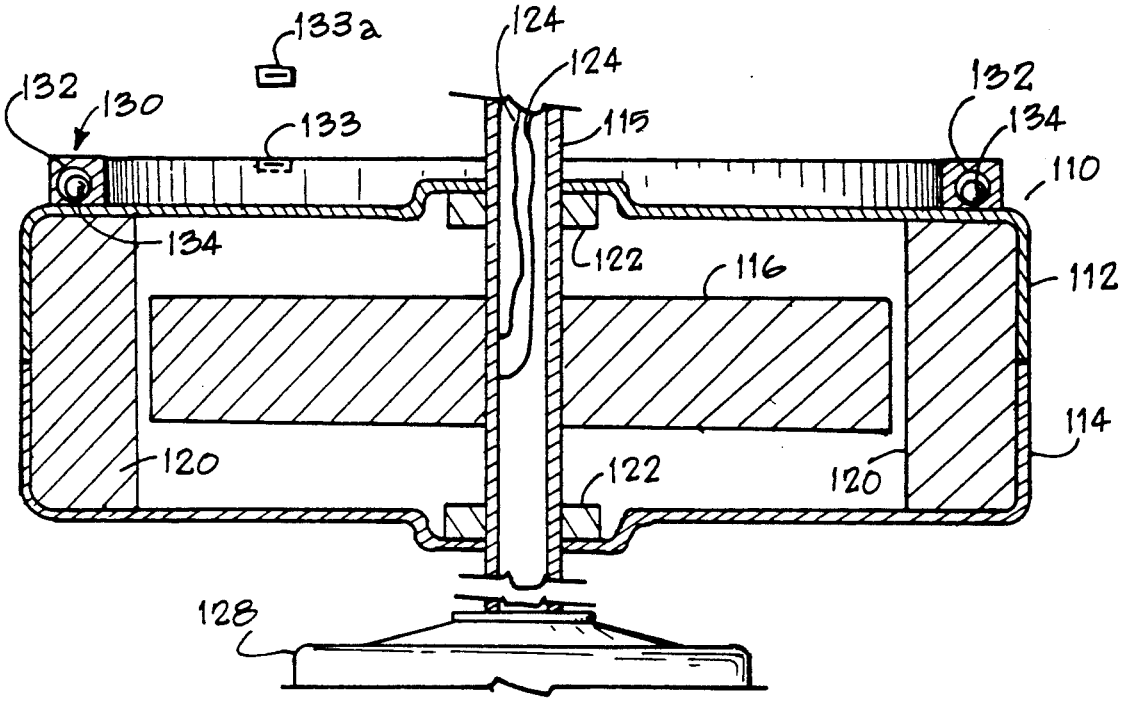
FIG. 3 is a partly cut-away cross-sectional view of a rotary ceiling fan electric motor housing having a second embodiment of the present invention incorporated thereon.

Referring now to FIG. 3, there is shown the ceiling fan electric motor housing of second embodiment of the invention generally indicated by the numeral 110. Housing 110 has a top plate generally indicated by the numeral 112 and a bottom plate generally indicated by the numeral 114. Top plate 112 may be connected to bottom plate 114 by any conventional means such as welding, screwing, bolting or the like.

Housing 110 is adapted to rotate about central shaft 115. Central shaft 115 is connected at its upper end to cover 118 shown in FIG. 4. Central shaft 115 has a stator 116 of the electric motor contained in housing 110 connected thereto. Rigidly connected to housing 110 is rotor 120 which is positioned concentrically about stator 116. Rotor 120 and housing 110 rotate on bearings 122 connected to shaft 115 when stator 116 is electrically energized through electrical lines 124 as is known in the art. Typical of such electric ceiling fans is the fan shown in U.S. Pat. No. 4,720,241 which was incorporated by reference.

Figure 4:
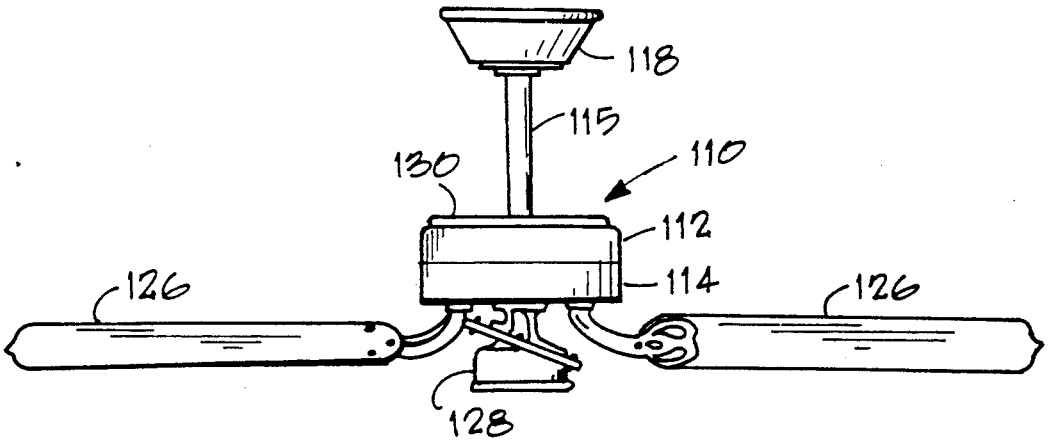
FIG. 4 is a plan view of a rotary ceiling fan utilizing the electric motor housing shown in FIG. 3.

Referring now to FIG. 4, the housing 110 can be seen to have fan blades 126—126 rigidly connected to bottom plate 114. Fan blades 126—126 therefore rotate with housing 110. A light bulb receptacle or other ornamental device 128 may be connected to the bottom of shaft 115 as shown in FIGS. 3 and 4. If desired, device 128 may be omitted.

To balance housing 110, and the entire ceiling fan assembly, there is provided a hollow circular ring generally indicated by the numeral 130 provided on the top plate 112 of housing 110 as shown in FIG. 3. Ring 130 extends completely around the interior of housing 110 and has a hollow center 132 which also extends completely around the interior of housing 110.

Inside of hollow center 132 are a plurality of metal spheres 134 to provide a balancing force. The number of metal spheres 134 may vary depending on the degree of imbalance of the ceiling fan and the combined weight of the spheres. An access port 133 to hollow center 132 is provided for adding or remove metal spheres to ring 30 without the necessity of separating top plate 12 from bottom plate 14. Access port 133 is a threaded hole which can be selectively opened or closed by removing or replacing a screw 133*a* that threads therein.

Figure 5:
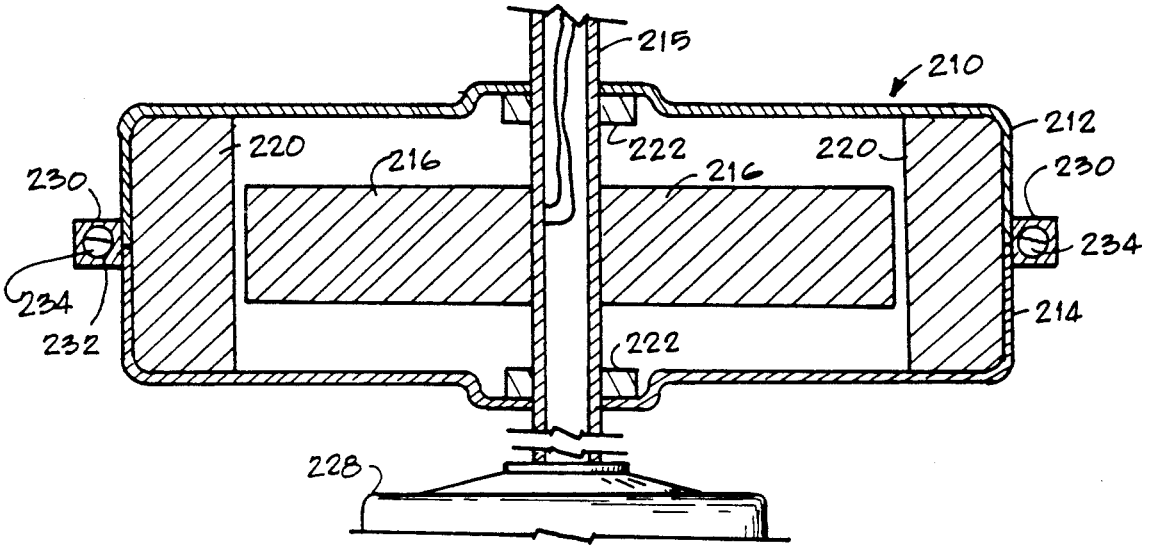
FIG. 5 is a partly cut-away cross-sectional view of a rotary ceiling fan electric motor housing having a third embodiment of the balancing apparatus of the present invention incorporated therein.

Referring now to FIG. 5, there is shown the ceiling fan electric motor housing of second embodiment of the invention generally indicated by the numeral 210. Housing 210 has a top plate generally indicated by the numeral 212 and a bottom plate generally indicated by the numeral 214. Top plate 212 may be connected to bottom plate 214 by any conventional means such as welding, screwing, bolting or the like.

Housing 210 is adapted to rotate about central shaft 215. Central shaft 215 is connected at its upper end to cover 218 shown in FIG. 6. Central shaft 215 has a stator 216 of the electric motor contained in housing 210 connected thereto. Rigidly connected to housing 210 is rotor 220 which is positioned concentrically about stator 216. Rotor 220 and housing 210 rotate on bearings 222 connected to shaft 215 when stator 216 is electrically energized through electrical lines 224 as is known in the art. Typical of such electric ceiling fans is the fan shown in U.S. Pat. No. 4,720,241 which was incorporated by reference.

Figure 6:
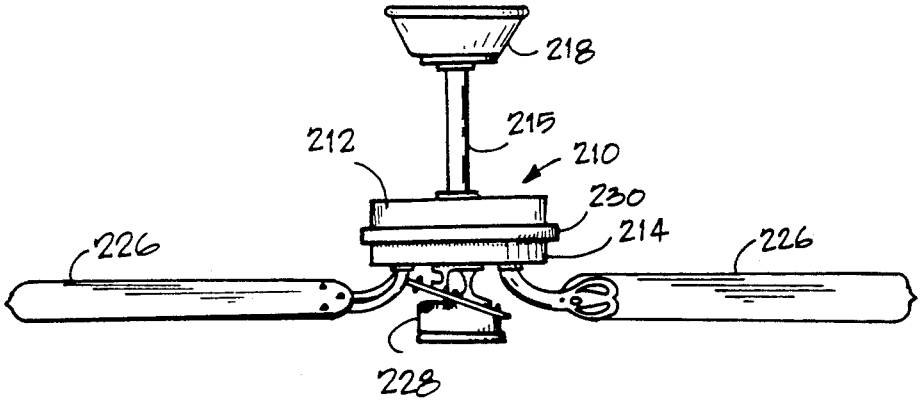
FIG. 6 is a plan view of a rotary ceiling fan utilizing the electric motor housing shown in FIG. 5.

Referring now to FIG. 6, the housing 210 can be seen to have fan blades 226—226 rigidly connected to bottom plate 214. Fan blades 226—226 therefore rotate with housing 210. A light bulb receptacle or other ornamental device 228 may be connected to the bottom of shaft 215 as shown in FIGS. 5 and 6. If desired, device 228 may be omitted.

To balance housing 210, and the entire ceiling fan assembly, there is provided a hollow circular ring generally indicated by the numeral 230 provided on the outside of housing 210 as shown in FIG. 5. Ring 230 extends completely around the outside of housing 210 and has a hollow center 232 which also extends completely around the ring 130.

Inside of hollow center 232 is a liquid 234 such as water or denser liquids such as mercury. The amount of liquid may vary depending on the degree of imbalance of the ceiling fan and the combined weight of the liquid. An access port may be provided for adding or remove liquid.

Figure 7:
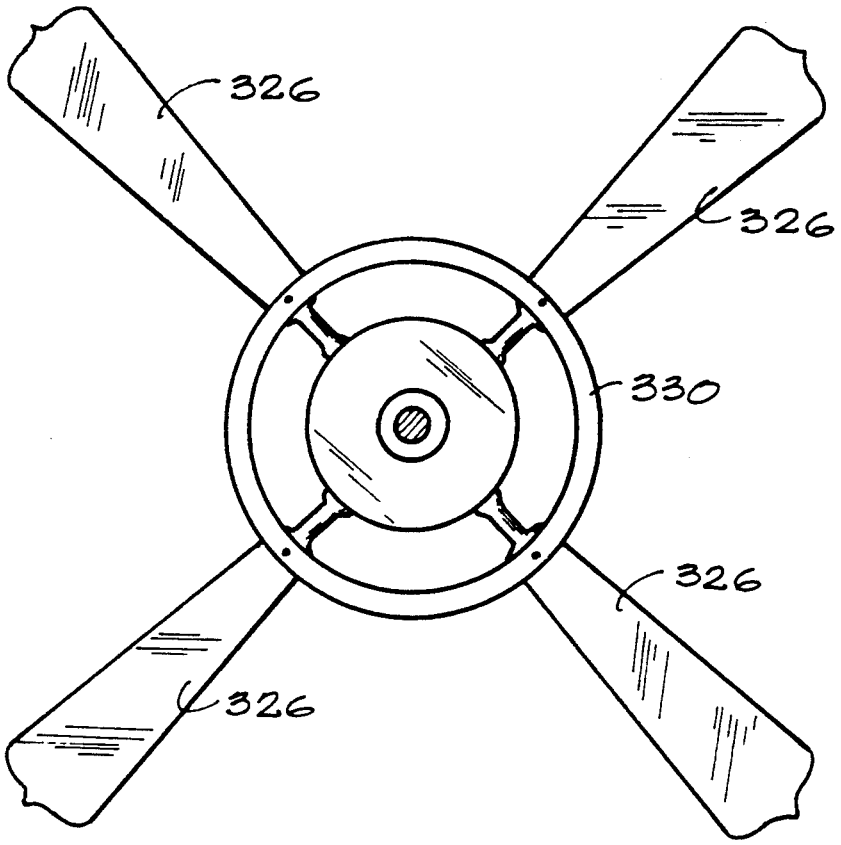
FIG. 7 is a partly cut-away cross-sectional view of a rotary ceiling fan electric motor housing having a fourth embodiment of the balancing apparatus of the present invention incorporated therein.
Figure 8:
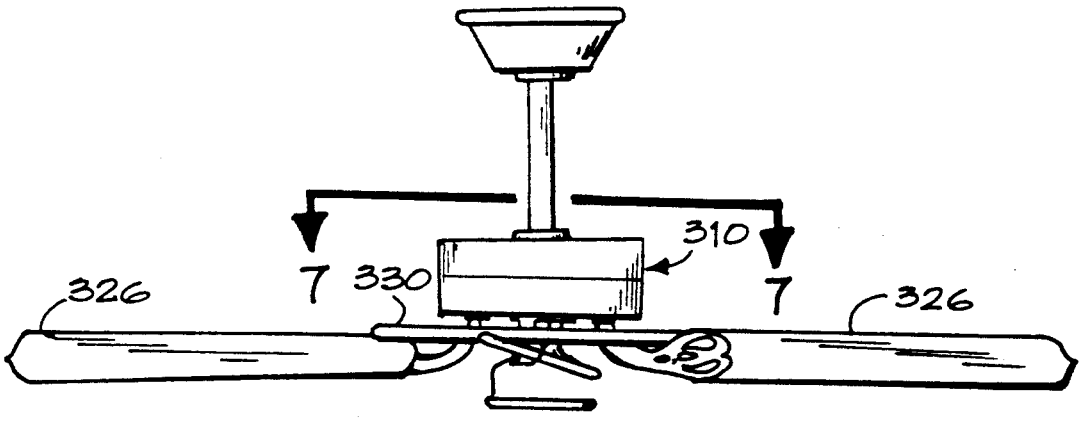
FIG. 8 is a plan view of a rotary ceiling fan utilizing the electric motor housing shown in FIG. 7.

Referring now to FIGS. 7 and 8, there is shown a hollow balancing ring 330 rigidly connected to fan blades 326. Ring 330 is identical to rings 130 and 230 in shape. Ring 330 extends completely around the outside of housing 310 and has a hollow center identical to center 132 and 232 which extends completely around the ring. Housing 310 is similar in design to housing 10, 110, and 210 with the exception that there is no ring on the housing 310.

Inside of the hollow center of ring 330 are a plurality of metal spheres or a liquid to provide a balancing force. In all of the above embodiments of the invention, metal spheres may be substituted for liquid, and liquid may be substituted for metal spheres. If desired, a combination of metal spheres and liquid may be utilized.

Although the preferred embodiments of the invention have been described in detail above, it should be understood that the invention is in no sense limited thereby, and its scope is to be determined by that of the following claims.

What is claimed is:

1. An apparatus for balancing a ceiling fan having an electric motor with a generally cylindrical rotating housing having a top and a generally cylindrical outside wall comprising, in combination:

a. a central stationary shaft for supporting said fan, said central shaft having a stationary stator for receiving electrical energy rigidly connected thereto, b. a rotatable housing enclosing said stator and containing a rotor for forcing said housing to rotate around said central stationary shaft when said stator is receiving electrical energy, said rotatable housing being rotatably connected to said central shaft means, c. a plurality of fan blades connected to said rotatable housing, d. a hollow ring connected to said rotating housing for holding movable weight means, and e. movable weight means located within said hollow ring for balancing said ceiling fan when said rotatable housing is rotating.

2. The apparatus of claim 1 wherein said weight means are metal spheres.

3. The apparatus of claim 1 wherein said ring means is connected to said outside of said rotating housing.

4. The apparatus of claim 1 wherein said ring means is connected to said top of said housing.

5. The apparatus of claim 1 wherein said ring means is connected to the inside of said outside wall.

6. The apparatus of claim 1 wherein said weight means is a liquid.

7. The apparatus of claim 6 wherein said liquid is water.

8. The apparatus of claim 1 wherein said weight means comprises metal spheres and a liquid.

9. The apparatus of claim 8 wherein said liquid means is water.

10. An apparatus for balancing a ceiling fan having an electric motor with a generally cylindrical rotating housing having a top and a generally cylindrical outside wall comprising, in combination:

a. a central stationary shaft for supporting said fan, said central shaft having a stationary stator for receiving electrical energy rigidly connected thereto, b. a rotatable housing enclosing said stator and containing a rotor for forcing said housing to rotate around said central stationary shaft when said stator is receiving electrical energy, said rotatable housing being rotatably connected to said central shaft means, c. a plurality of fan blades connected to said rotatable housing, d. a hollow ring connected to said plurality of fan blades for holding movable weight means, and e. movable weight means located within said hollow ring for balancing said ceiling fan when said rotatable housing is rotating.

11. The apparatus of claim 10 wherein said weight means are metal spheres.

12. The apparatus of claim 10 wherein said weight means is a liquid.

13. The apparatus of claim 12 wherein said liquid is water.

14. The apparatus of claim 11 wherein said weight means comprises metal spheres and a liquid.

15. The apparatus of claim 14 wherein said liquid means is water.

* * * * *